US010054120B2

(12) United States Patent
Kawai et al.

(10) Patent No.: US 10,054,120 B2
(45) Date of Patent: Aug. 21, 2018

(54) VOLUTE PUMP

(71) Applicant: EBARA CORPORATION, Tokyo (JP)

(72) Inventors: Masahito Kawai, Tokyo (JP); Hiromi Sakacho, Tokyo (JP); Masashi Obuchi, Tokyo (JP); Hiroshi Uchida, Tokyo (JP); Miho Isono, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 276 days.

(21) Appl. No.: 14/760,130

(22) PCT Filed: Jan. 14, 2014

(86) PCT No.: PCT/JP2014/050452
§ 371 (c)(1),
(2) Date: Jul. 9, 2015

(87) PCT Pub. No.: WO2014/112473
PCT Pub. Date: Jul. 24, 2014

(65) Prior Publication Data

US 2015/0354558 A1 Dec. 10, 2015

(30) Foreign Application Priority Data

Jan. 15, 2013 (JP) ..... 2013-004801

(51) Int. Cl.
*F04D 29/44* (2006.01)
*F04C 2/02* (2006.01)
(Continued)

(52) U.S. Cl.
CPC ..... *F04C 2/025* (2013.01); *F04D 7/045* (2013.01); *F04D 29/428* (2013.01); *F04D 29/448* (2013.01)

(58) Field of Classification Search
CPC ..... F04C 2/025; F04D 7/045; F04D 29/428; F04D 29/448
(Continued)

(56) References Cited

U.S. PATENT DOCUMENTS 5,114,311 A 5/1992 Becker et al.
5,551,839 A * 9/1996 Schuster ..... F04D 29/426 415/212.1
(Continued)

FOREIGN PATENT DOCUMENTS

CN 85105293 A 1/1987
JP 61-501939 A 9/1986
(Continued)

OTHER PUBLICATIONS

Extended European Search Report issued in Patent Application No. EP 14 74 0740.7 dated Sep. 22, 2016.
(Continued)

*Primary Examiner* — Aaron R Eastman
(74) *Attorney, Agent, or Firm* — Pearne & Gordon LLP

(57) ABSTRACT

The present invention relates to a volute pump and particularly provides a volute pump for delivering a liquid containing fibrous substances and solid substances, while preventing these substances from obstructing the pump. The volute pump includes a pump casing (10) having a protrusion (14) projecting into a flow passage (11) and separating a starting end of a volute from a terminal end of a volute. The protrusion (14) faces a liquid outlet (23) of an impeller (20). A radius of curvature (Rb) of a cross section of a distal edge of the protrusion (14) at its one side end (14*b*) is larger than a radius of curvature (Ra) of the cross section of the distal edge of the protrusion (14) at other side end (14*a*). The other side end (14*a*) faces a main plate (20*a*), while the one side end (14*b*) is located opposite to the main plate (20*a*).

8 Claims, 11 Drawing Sheets

(51) Int. Cl.
*F04D 7/04* (2006.01)
*F04D 29/42* (2006.01)

(58) Field of Classification Search
USPC ..... 415/204
See application file for complete search history.

(56) References Cited

U.S. PATENT DOCUMENTS

| | | | | |
|---|---|---|---|---|
| 5,779,444 | A * | 7/1998 | Onigata | F04D 29/428 415/206 |
| 6,126,392 | A * | 10/2000 | Sabini | F04D 15/0088 415/118 |
| 8,747,062 | B2 * | 6/2014 | Burgess | F04D 29/428 415/196 |
| 2004/0126228 | A1 * | 7/2004 | Roudnev | F04D 7/045 415/196 |

FOREIGN PATENT DOCUMENTS

| | | | |
|---|---|---|---|
| JP | 2003-322099 | A | 11/2003 |
| JP | 2005-240766 | A | 9/2005 |
| JP | 2008-067746 | A | 3/2008 |
| WO | 98/34658 | A1 | 8/1998 |
| WO | 2011/138188 | A1 | 11/2011 |

OTHER PUBLICATIONS

International Search Report for Application No. PCT/JP2014/05042 dated Apr. 15, 2014.
Microfilm of the specification and drawings annexed to the request of Japanese Utility Model Application No. 096315/1978(Laid-open No. 014059/1980) (Hitachi, Ltd.), Jan. 29, 1980 (Jan. 29, 1980).

* cited by examiner

VOLUTE PUMP

TECHNICAL FIELD

The present invention relates to a volute pump, and more particularly to a volute pump for delivering a liquid containing fibrous substances and solid substances while preventing these substances from obstructing the pump.

BACKGROUND ART

FIG. 1 is a view showing a meridian plane of a conventional volute pump, and FIG. 2 is a cross-sectional view taken along line II-II of FIG. 1. As shown in FIGS. 1 and 2, a liquid, which has flowed through an inlet port 1 into an impeller 20, is given velocity energy by the rotation of the impeller 20, and is discharged in a circumferential direction into a volute-shaped flow passage 11 defined in a pump casing 10. The flow passage 11 is formed such that its cross-sectional area increases gradually as it approaches a downstream side. Because of this gradually-increasing cross-sectional area of the flow passage 11, the velocity of the liquid that is flowing downstream through the flow passage 11 is decreased while its velocity energy is converted into pressure energy. The liquid is discharged out through an outlet port 2.

The pump casing 10 includes a protrusion 12 located near a terminal end of the volute and projecting into the flow passage 11 that is in the shape of volute. This protrusion 12 separates a starting end of the volute from the terminal end of the volute. FIG. 3 is a view showing the protrusion 12 and the impeller 20 as viewed from a direction indicated by arrow A in FIG. 2. As shown in FIG. 3, a gap C is formed between the protrusion 12 and the impeller 20. The protrusion 12 has a distal edge that is formed by a curved surface whose cross section is represented by a circle of curvature (indicated by dotted lines in FIG. 3). This circle of curvature has a radius of curvature R that is constant throughout the protrusion 12 from one side end to the other side end of the protrusion 12. In FIG. 3, a dot-and-dash line represents a position of the center of the circle of curvature of the distal-edge cross section of the protrusion 12.

As shown in FIG. 2, the liquid that flows through the flow passage 11 is divided by the protrusion 12, whereby a part of the liquid passes through the gap C to circulate in the pump casing 10. In consideration of the pump efficiency, it is desirable that the radius of curvature of the cross section of the distal edge of the protrusion 12 be small in order for the protrusion 12 not to cause a disturbance of the flow of the liquid. Furthermore, the gap C between the protrusion 12 and the impeller 20 should desirably be small in order to reduce an amount of the circulating flow.

As shown in FIG. 3, when the velocity of the liquid in the pump casing 10 is high, i.e., when the flow rate of the liquid is high, most of the liquid, which has been introduced through the inlet port 1 into the impeller 20, flows along a main plate 20*a* of the impeller 20. When the velocity of the liquid in the pump casing 10 is low, i.e., when the flow rate of the liquid is low, most of the liquid flows along a side plate 20*b* that is opposite to the main plate 20*a*. Although FIG. 1 illustrates an example of a closed-type impeller which has the main plate 20*a* and the side plate 20*b*, the liquid flows in the same manner in an open-type impeller which is free of main and side plates and in a semi-open-type impeller which is free of a side plate.

CITATION LIST

Patent Literature

Patent document 1: Japanese laid-open patent publication No. 2005-240766

Patent document 2: Japanese laid-open patent publication No. 61-501939

SUMMARY OF INVENTION

Technical Problem

When the above-described conventional volute pump is operated to deliver a liquid containing fibrous substances and solid substances, the fibrous substances are likely to be caught particularly by the protrusion 12 as shown in FIG. 4, and the solid substances are also liable to clog the gap C. If the fibrous substances are continuously caught by the protrusion 12 and the solid substances continuously clog the gap C, the flow passage 11 may be obstructed or the impeller 20 may fail to rotate, resulting in a pumping failure. The fibrous substances are more likely to be caught by the protrusion 12 and the solid substances are more likely to clog the gap C when the flow velocity of the liquid in the pump casing 10 is low, i.e., the flow rate of the liquid discharged from the pump is low.

The present invention is aimed at solving the above problems in the background art. It is an object of the present invention to provide a volute pump having an improved structure that can allow fibrous substances and solid substances to pass through the pump without causing a significant reduction in a pump efficiency.

Solution to Problem

To achieve the above object, in accordance with a first aspect of the present invention, there is provided a volute pump comprising: an impeller having a main plate and a rotary vane fixed to the main plate; and a pump casing having a flow passage in a shape of volute for delivering a liquid, discharged from the impeller, in a circumferential direction, wherein the pump casing includes a protrusion projecting into the flow passage and separating a starting end of the volute from a terminal end of the volute, the protrusion faces a liquid outlet of the impeller, and a radius of curvature of a cross section of a distal edge of the protrusion at one side end thereof is larger than a radius of curvature of the cross section of the distal edge of the protrusion at other side end thereof, and the other side end faces the main plate while the one side end is located opposite to the main plate.

In a preferred aspect of the present invention, the radius of curvature of the cross section of the distal edge of the protrusion increases from a second value to a first value at a constant rate, where the first value is the radius of curvature at the one side end and the second value is the radius of curvature at the other side end.

In a preferred aspect of the present invention, the radius of curvature of the cross section of the distal edge of the protrusion increases stepwise from a second value to a first value, where the first value is the radius of curvature at the one side end and the second value is the radius of curvature at the other side end.

In a preferred aspect of the present invention, the radius of curvature of the cross section of the distal edge of the protrusion increases from a second value to a first value at a continuously varying rate of increase, where the first value is the radius of curvature at the one side end and the second value is the radius of curvature at the other side end.

In accordance with a second aspect of the present invention, there is provided a volute pump comprising an impeller having a main plate and a rotary vane fixed to the main plate; and a pump casing having a flow passage in a shape of volute for delivering a liquid, discharged from the impeller, in a circumferential direction, wherein the pump casing includes a protrusion projecting into the flow passage and separating a starting end of the volute from a terminal end of the volute, the protrusion faces a liquid outlet of the impeller, and a gap between the impeller and one side end of the protrusion is larger than a gap between the impeller and other side end of the protrusion, and the other side end faces the main plate while the one side end is located opposite to the main plate.

In a preferred aspect of the present invention, a gap between the protrusion and the impeller increases from a second value to a first value at a constant rate, where the first value is the gap between the one side end and the impeller and the second value is the gap between the other side end and the impeller.

In a preferred aspect of the present invention, a gap between the protrusion and the impeller increases stepwise from a second value to a first value, where the first value is the gap between the one side end and the impeller and the second value is the gap between the other side end and the impeller.

In a preferred aspect of the present invention, a gap between the protrusion and the impeller increases from a second value to a first value at a continuously varying rate of increase, where the first value is the gap between the one side end and the impeller and the second value is the gap between the other side end and the impeller.

Advantageous Effects of Invention

According to the first aspect of the present invention, the cross section of the distal edge of the protrusion at the side end that is located opposite to the main plate has the larger radius of curvature. Therefore, fibrous substances can more easily pass through the pump when the flow rate of the liquid is low. Furthermore, since the cross section of the distal edge of the protrusion at the other side end that faces the main plate has the smaller radius of curvature, the flow of the liquid is less liable to be disturbed by the protrusion when the flow rate of the liquid is high. Therefore, the pump efficiency is prevented from being lowered.

According to the second aspect of the present invention, the gap between the impeller and the side end of the protrusion opposite to the main plate is made larger, thereby allowing solid substances to pass through the pump more easily when the flow rate of the liquid is low. Furthermore, since the gap between the impeller and the other side end facing the main plate is made smaller, the amount of the circulating liquid is kept small, thereby preventing the pump efficiency from being significantly lowered.

DESCRIPTION OF EMBODIMENTS

Figure 1:
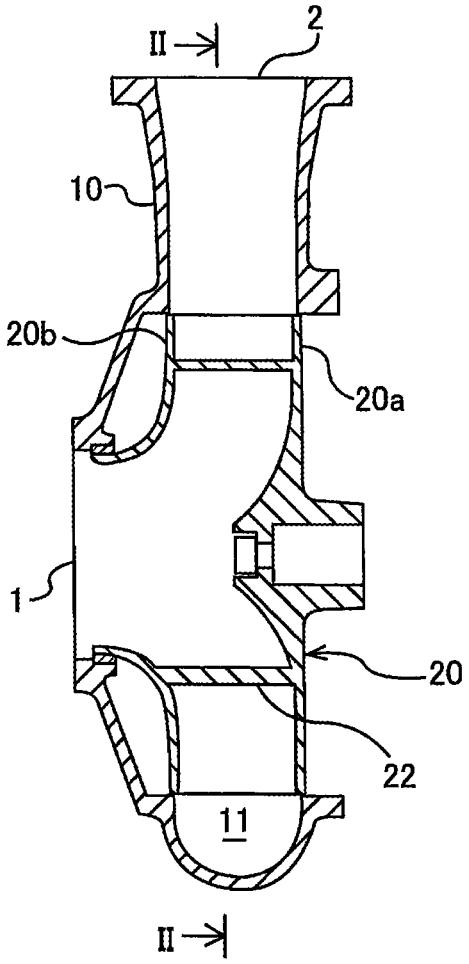
FIG. 1 is a view showing a meridian plane of a conventional volute pump.
Figure 2:
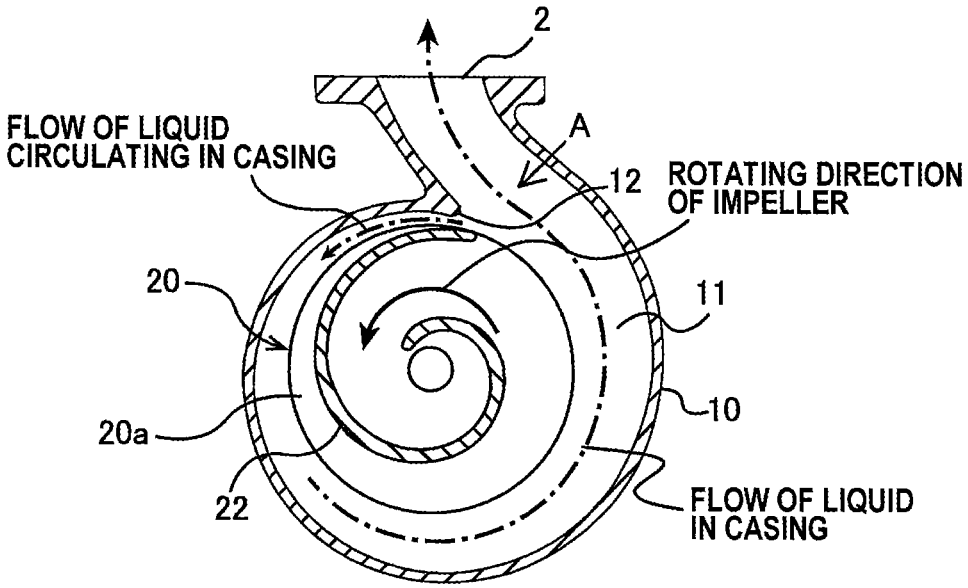
FIG. 2 is a cross-sectional view taken along line II-II of FIG. 1.
Figure 3:
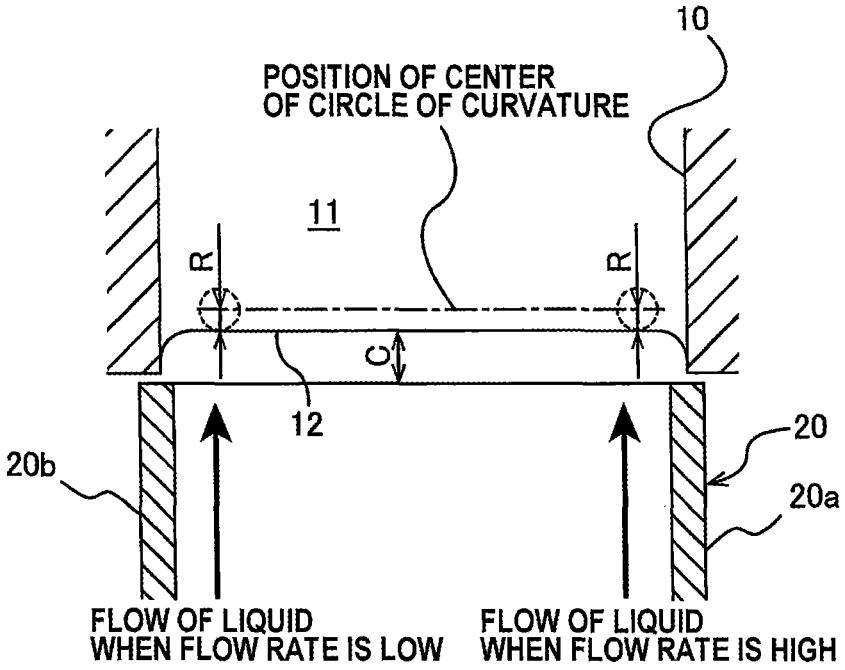
FIG. 3 is a view of a protrusion and an impeller shown in FIG. 2 as viewed from a direction indicated by arrow A.
Figure 4:
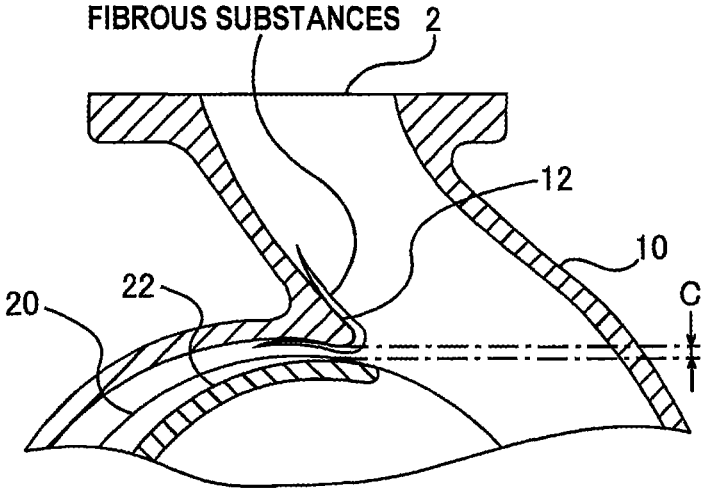
FIG. 4 is a view showing a fibrous substance that has been caught by the protrusion.
Figure 5:
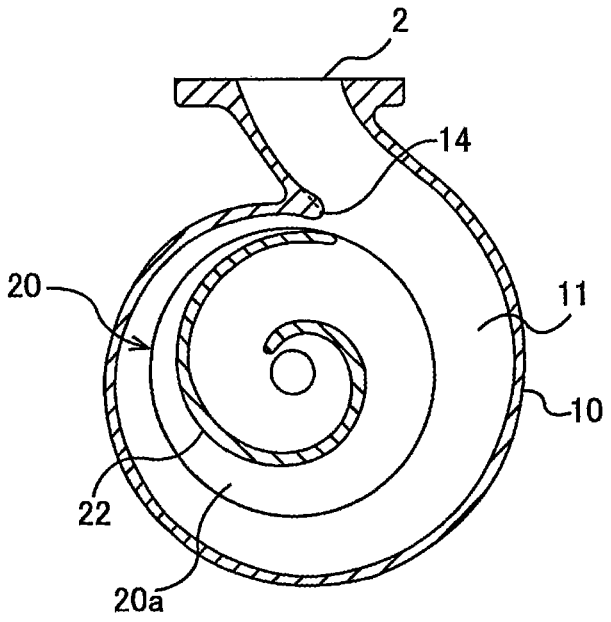
FIG. 5 is a cross-sectional view of a volute pump according to a first embodiment of the present invention.
Figure 6:
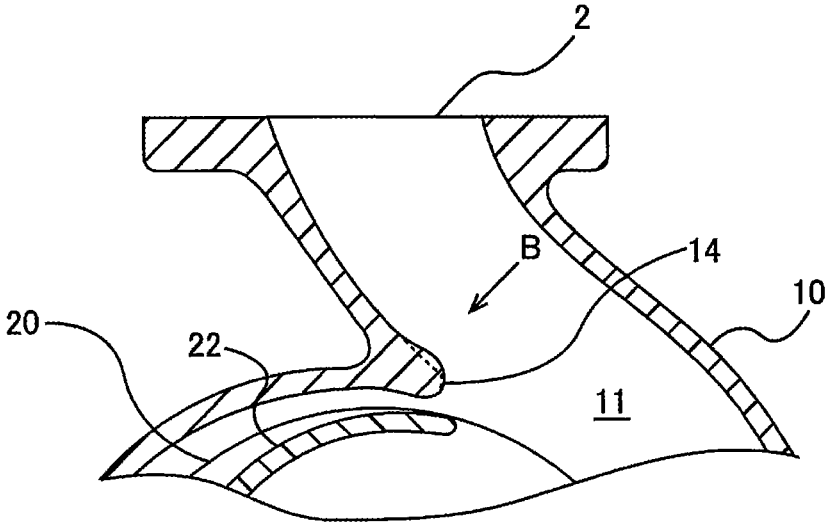
FIG. 6 is an enlarged view of a part of the pump shown in FIG. 5.
Figure 7:
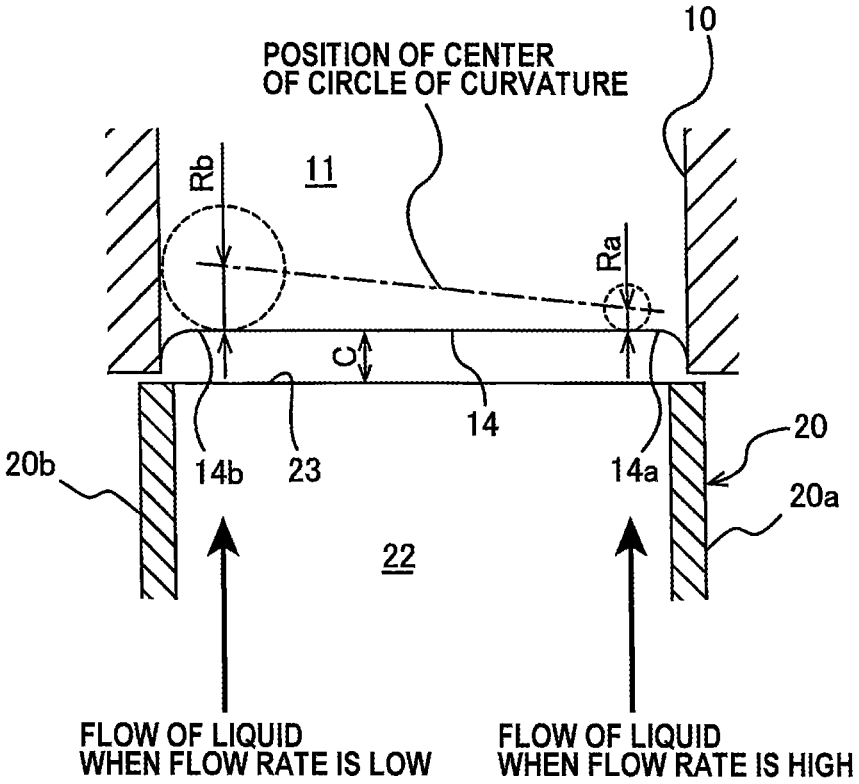
FIG. 7 is a view of the part shown in FIG. 6 as viewed from a direction indicated by arrow B.

Embodiments of the present invention will be described below with reference to the drawings. FIG. 5 is a cross-sectional view of a volute pump according to a first embodiment of the present invention, FIG. 6 is an enlarged view of a part of the pump shown in FIG. 5, and FIG. 7 is a view of the part shown in FIG. 6 as viewed from a direction indicated by arrow B. A diagram of a meridian plane of the volute pump according to the present embodiment is substantially the same as the diagram of the meridian plan shown in FIG. 1, and therefore a repetitive drawing is omitted.

The volute pump includes a pump casing 10 having an inlet port 1 (see FIG. 1) and an outlet port 2, and further includes an impeller 20 rotatably housed in the pump casing 10. The pump casing 10 includes a flow passage 11 in a shape of volute, and further includes a protrusion 14 located near a terminal end of the volute and projecting into the flow passage 11. This protrusion 14 separates a starting end of the volute from the terminal end of the volute.

The impeller 20 includes a main plate 20*a*, a side plate 20*b*, and a rotary vane 22. The rotary vane 22 extends spirally and is disposed between the main plate 20*a* and the side plate 20*b*. The impeller 20 of this type is a so-called closed-type impeller. The impeller 20 is fixed to a rotational shaft, not shown in the drawings, and is rotatable together with the rotational shaft 21 by a driving device (motor or the like), not shown in the drawings. The rotating impeller 20 gives velocity energy to the liquid, which is discharged into the volute-shaped flow passage 11 from a liquid outlet 23 that is defined in a circumferential portion of the impeller 20. As shown in FIG. 7, a gap C is formed between the protrusion 14 and the impeller 20.

The protrusion 14 is provided so as to face the liquid outlet 23 of the impeller 20. The protrusion 14 has a distal edge formed by a curved surface whose cross section is represented by a circle of curvature depicted by dotted lines shown in FIG. 7. In FIG. 7, a dot-and-dash line represents a position of the center of the circle of curvature of the distal-edge cross section of the protrusion 14. As shown in FIG. 7, a radius of curvature Rb of the cross section of the distal edge at one side end 14*b* of the protrusion 14 is larger than a radius of curvature Ra at other side end 14*a* of the protrusion 14. The side end 14*a* of the protrusion 14 faces the main plate 20*a* of the impeller 20, while the side end 14*b* of the protrusion 14 is located opposite to the main plate 20*a* of the impeller 20. In this embodiment, the side end 14*b* of the protrusion 14 faces the side plate 20*b* of the impeller 20. In the example shown in FIG. 7, the radius of curvature of the cross section of the distal edge of the protrusion 14 increases from Ra to Rb at a constant rate.

As shown in FIG. 7, when a flow rate of the liquid flowing in the impeller 20 is high, the liquid flows along the main plate 20*a* of the impeller 20. When the flow rate of the liquid flowing in the impeller 20 is low, the liquid flows along the side plate 20*b* that is located opposite to the main plate. When the flow rate is low, fibrous substances are significantly likely to be caught by the protrusion 14. According to the present embodiment, the cross section of the distal edge of the protrusion 14 at the side end 14*b*, which is located at the opposite main-plate side, has the larger radius of curvature Rb. Therefore, fibrous substances are less likely to be caught by the protrusion 14 when the flow rate of the liquid flowing in the impeller 20 is low. Furthermore, since the cross section of the distal edge of the protrusion 14 at the side end 14*a* that faces the main plate 20*a* has the smaller radius of curvature Ra, the flow of the liquid is less likely to be disturbed by the protrusion 14 when the flow rate of the liquid flowing in the impeller 20 is high. Therefore, the pump efficiency is prevented from being lowered when the flow rate of the liquid is high.

Figure 8:
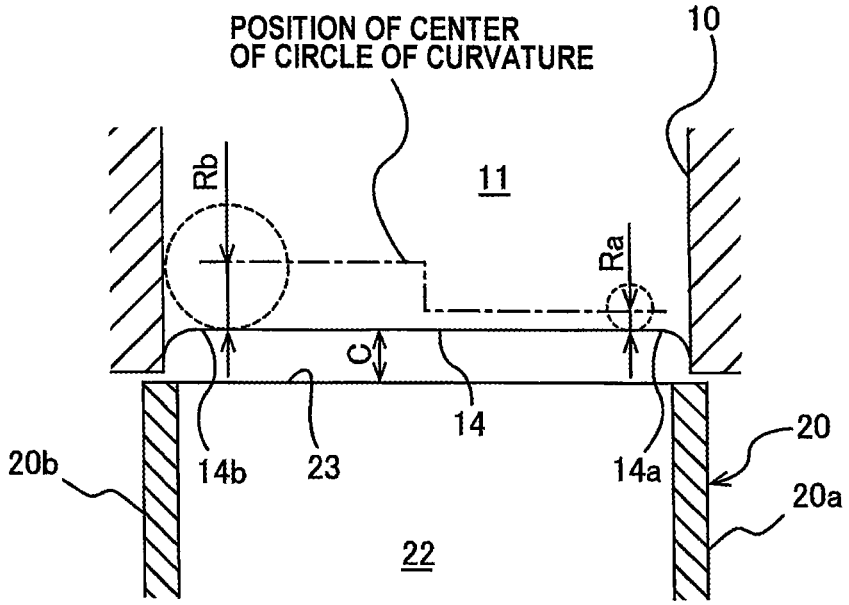
FIG. 8 is a view showing a modification of the embodiment shown in FIG. 5.
Figure 9:
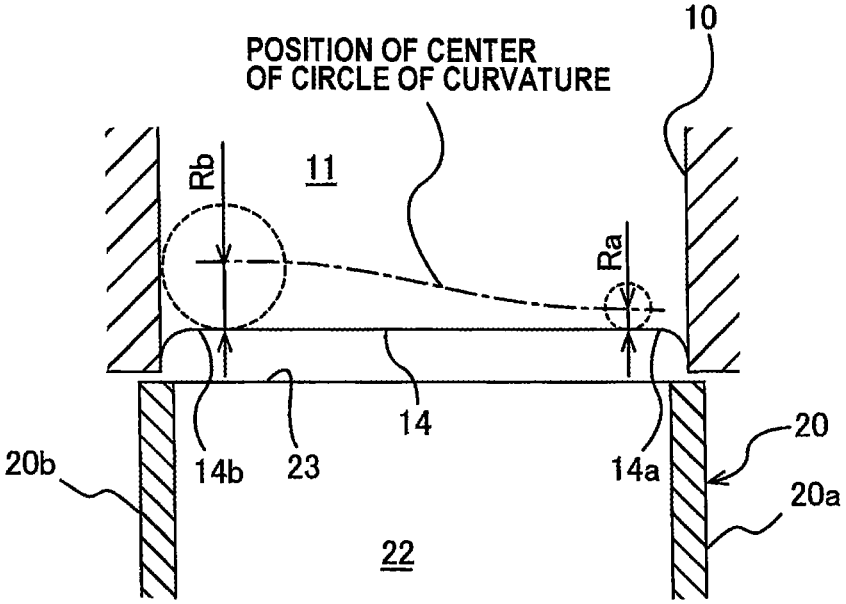
FIG. 9 is a view showing another modification of the embodiment shown in FIG. 5.

In the example shown in FIG. 7, the radius of curvature of the cross section of the distal edge of the protrusion 14 increases from Ra to Rb at a constant rate. However, the present invention is not limited to this example so long as the relationship between the radius of curvature Rb and the radius of curvature Ra satisfies a condition Rb>Ra. For example, as shown in FIG. 8, the radius of curvature of the cross section of the distal edge of the protrusion 14 may increase stepwise from Ra to Rb, or as shown in FIG. 9, a rate of increase in the radius of curvature of the cross section of the distal edge of the protrusion 14 may vary continuously.

Figure 10:
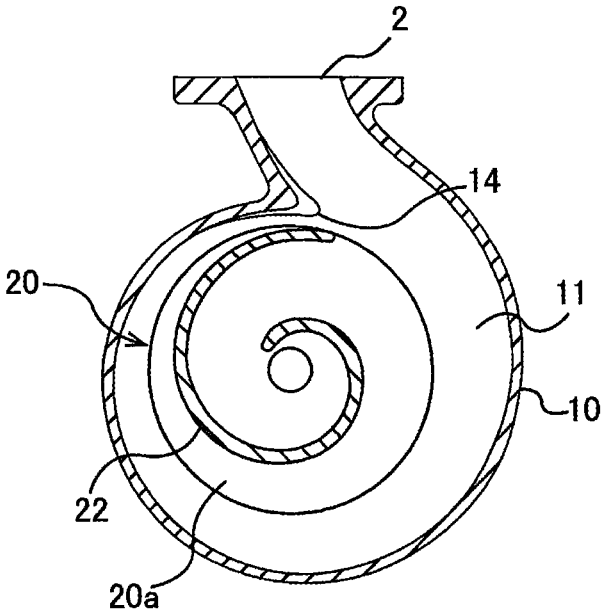
FIG. 10 is a cross-sectional view of a volute pump according to a second embodiment of the present invention.
Figure 11:
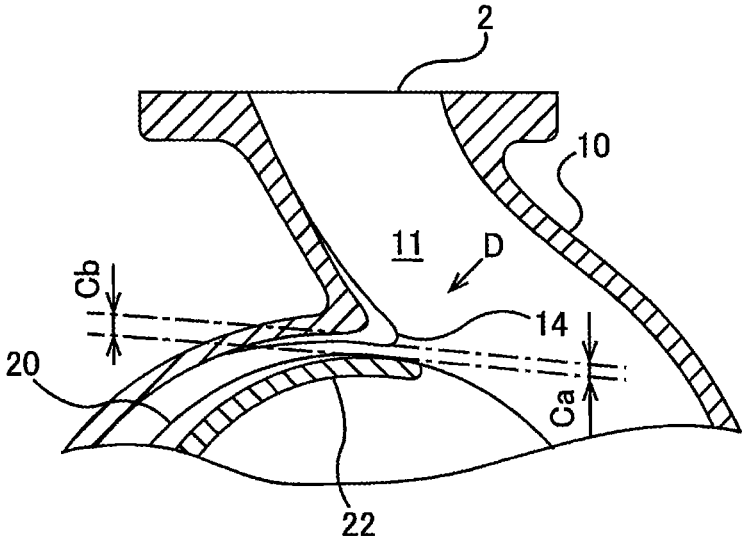
FIG. 11 is an enlarged view of a part of the pump shown in FIG. 10.
Figure 12:
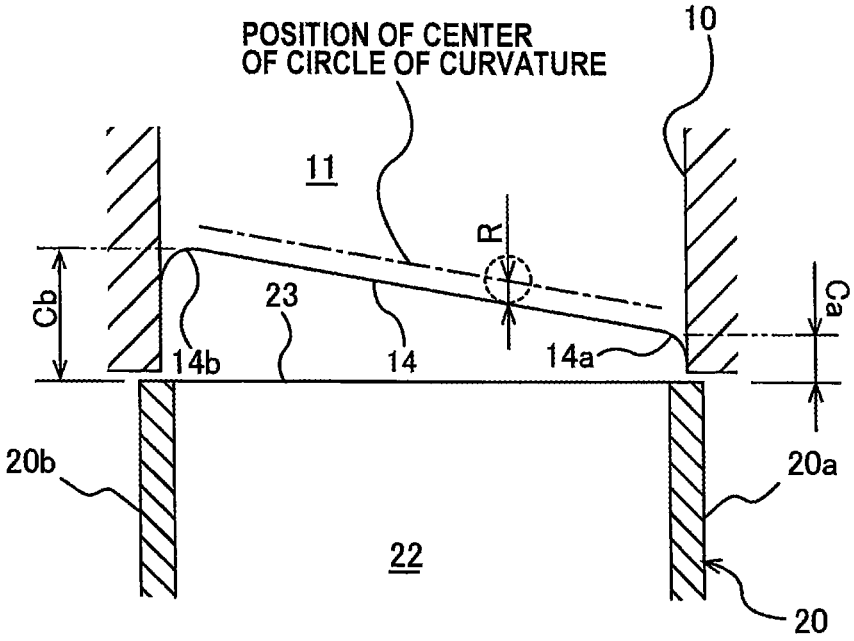
FIG. 12 is a view of the part shown in FIG. 10 as viewed from a direction indicated by arrow D.

FIG. 10 is a cross-sectional view of a volute pump according to a second embodiment of the present invention, FIG. 11 is an enlarged view of a part of the pump shown in FIG. 10, and FIG. 12 is a view of the part shown in FIG. 10 as viewed from a direction indicated by arrow D. As shown in FIG. 12, a gap between the protrusion 14 and the liquid outlet 23 defined in the circumferential portion of the impeller 20 varies along a direction across the flow passage 11. More specifically, a gap Cb between the impeller 20 and the one side end 14*b* of the protrusion 14 which faces the side plate 20*b* of the impeller 20 is larger than a gap Ca between the impeller 20 and the other side end 14*a* which faces the main plate 20*a*.

According to the present embodiment, although the radius of curvature R of the cross section of the distal edge of the protrusion 14 is constant, the gap Cb at the side end 14*b* of the protrusion 14, which is opposite to the main plate, is made larger, thereby preventing solid substances from being caught between the protrusion 14 and the circumferential portion of the impeller 20 when the flow rate of the liquid flowing in the impeller 20 is low. Furthermore, since the gap Ca at the side end 14*a* facing the main plate 20*a* is made smaller, the amount of the circulating flow that circulates in the pump casing 10 is reduced, thereby preventing a drastic decrease in the pump efficiency.

Figure 13:
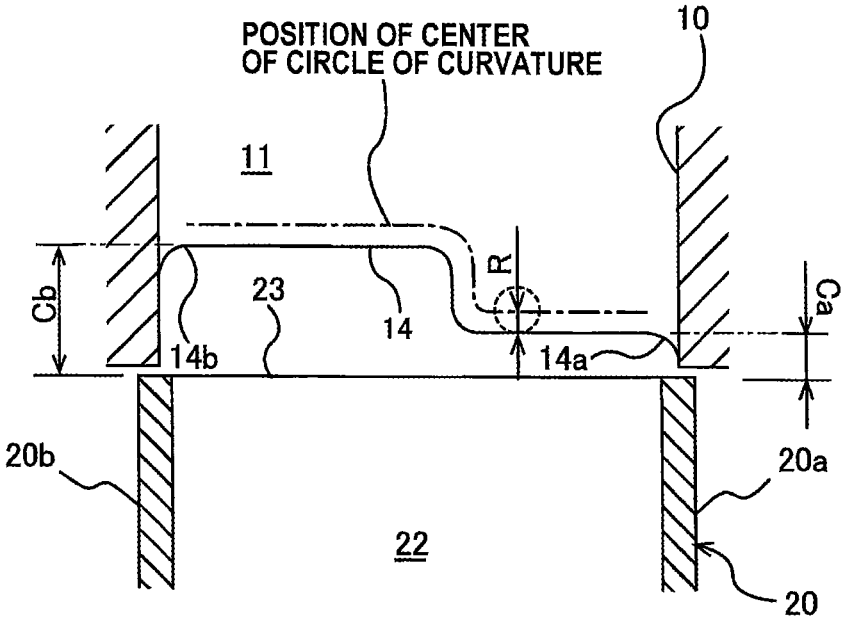
FIG. 13 is a view showing a modification of the embodiment shown in FIG. 12.
Figure 14:
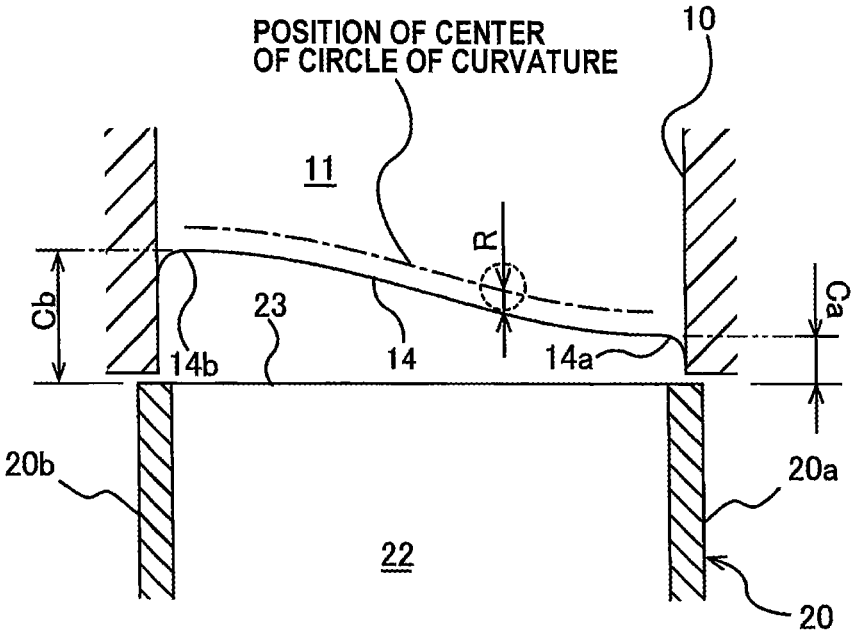
FIG. 14 is a view showing another modification of the embodiment shown in FIG. 12.

FIG. 12 shows an example in which the gap between the protrusion 14 and the impeller 20 increases from Ca to Cb at a constant rate. However, the present invention is not limited to this example so long as the relationship between the gap Cb and the gap Ca satisfies a condition Cb>Ca. For example, as shown in FIG. 13, the gap between the protrusion 14 and the impeller 20 may increase stepwise from Ca to Cb, or as shown in FIG. 14, a rate of increase in the gap between the protrusion 14 and the impeller 20 may vary continuously.

Figure 15:
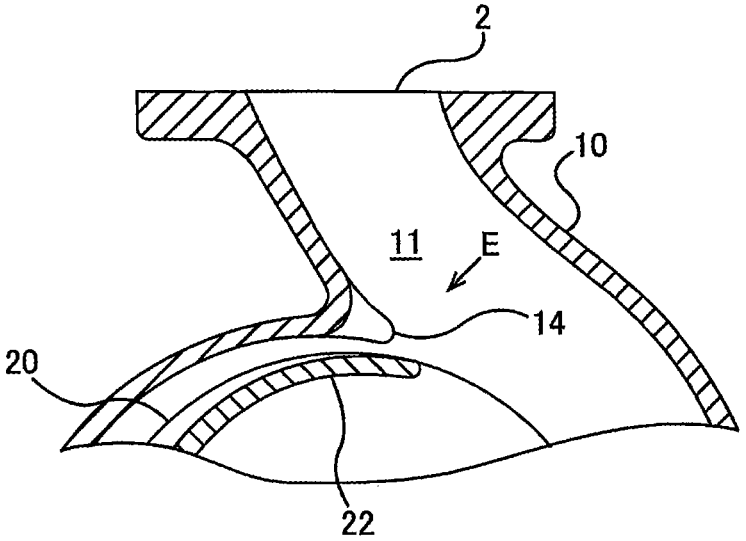
FIG. 15 is a view showing a combination of the first embodiment and the second embodiment.
Figure 16:
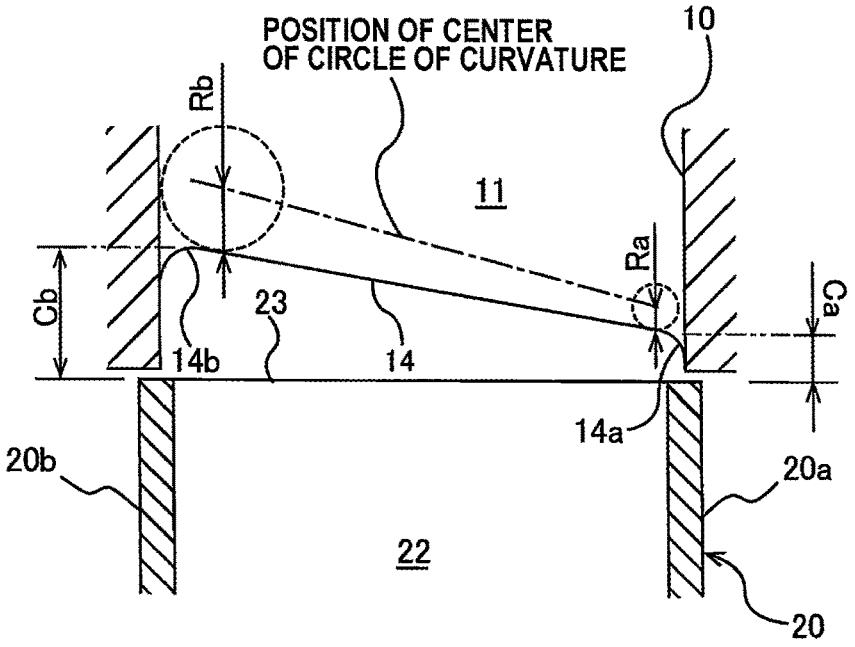
FIG. 16 is a view of a part of the pump shown in FIG. 15 as viewed from a direction indicated by arrow E.

As shown in FIG. 15, the first embodiment and the second embodiment may be combined. FIG. 16 is a view of a part of the pump shown in FIG. 15 as viewed from a direction indicated by arrow E. As shown in FIG. 16, the gap Cb and the gap Ca satisfy the condition Cb>Ca, and the radius of curvature Rb and the radius of curvature Ra satisfy the condition Rb>Ra. The volute pump according to the present embodiment can prevent fibrous substances from being caught by the protrusion 14 and can further prevent solid substances from clogging the gap between the protrusion 14 and the circumferential portion of the impeller 20 when the flow rate of the liquid is low.

Figure 17:
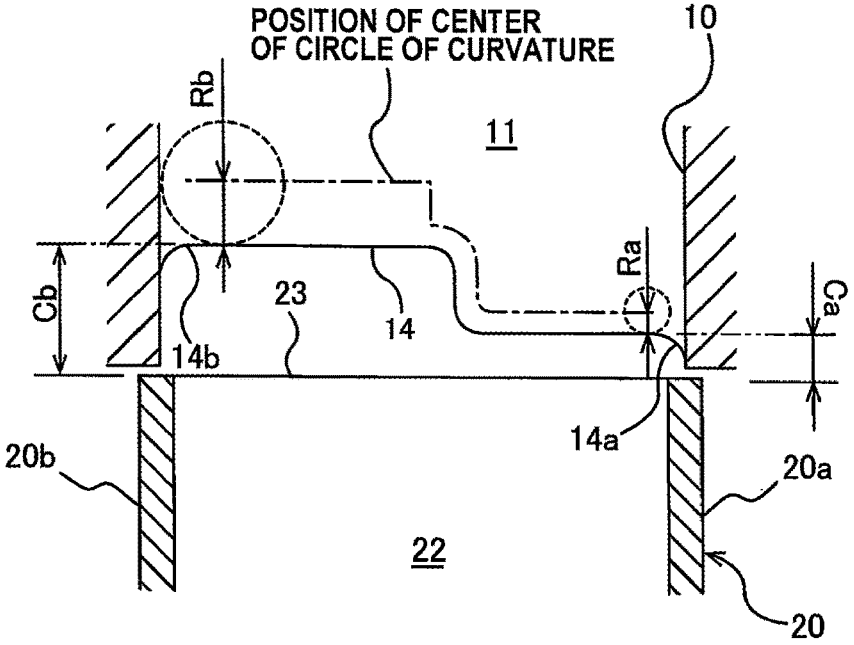
FIG. 17 is a view showing a modification of the volute pump shown in FIG. 15.
Figure 18:
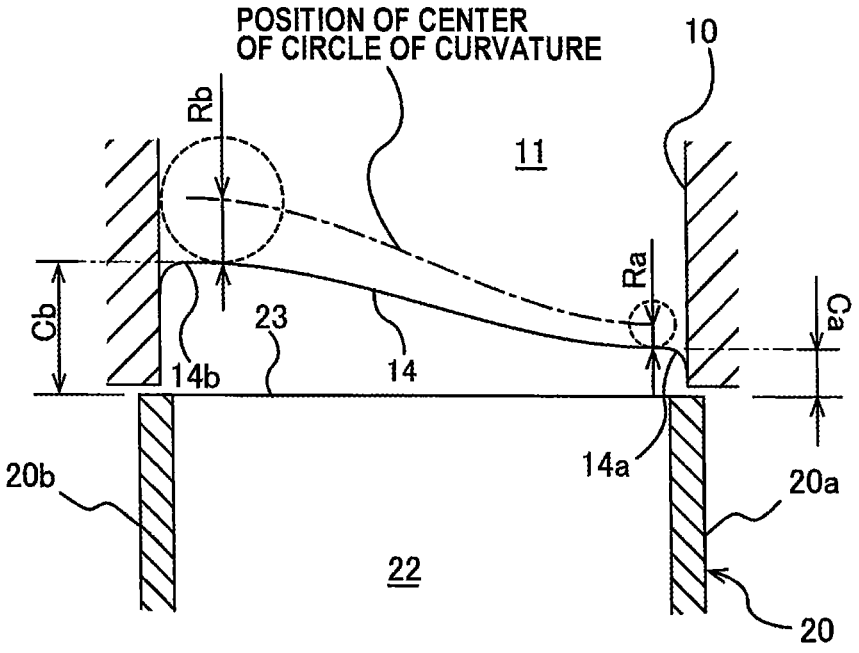
FIG. 18 is a view showing another modification of the volute pump shown in FIG. 15.

In FIG. 16, the gap between the protrusion 14 and the impeller 20 increases from Ca to Cb at a constant rate, and the radius of curvature of the cross section of the distal edge of the protrusion 14 increases from Ra to Rb at a constant rate. As shown in FIG. 17, the gap between the protrusion 14 and the impeller 20 may increase stepwise from Ca to Cb, and the radius of curvature of the cross section of the distal edge of the protrusion 14 may increase stepwise from Ra to Rb. Furthermore, as shown in FIG. 18, the rate of increase in the gap between the protrusion 14 and the impeller 20 may vary continuously, and the rate of increase in the radius of curvature of the cross section of the distal edge of the protrusion 14 may vary continuously. The first embodiment and the second embodiment can thus be combined with each other without impairing the respective advantages thereof.

The above embodiments are directed to a volute pump having a so-called closed-type impeller, while the present invention is also applicable to a volute pump having an open-type impeller and a volute pump having a semi-open-type impeller.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention relates to a volute pump, and is more particularly applicable to a volute pump for delivering a liquid containing fibrous substances and solid substances.

REFERENCE SIGNS LIST

1 inlet port
2 outlet port
10 pump casing

12, 14 protrusion
11 flow passage
20 impeller
20*a* main plate
20*b* side plate
22 rotary vane
23 liquid outlet

The invention claimed is:

1. A volute pump comprising:

an impeller having a main plate and a rotary vane fixed to the main plate; and a pump casing having a flow passage in a shape of volute for delivering a liquid, discharged from the impeller, in a circumferential direction, wherein the pump casing includes a protrusion projecting into the flow passage and separating a starting end of the volute from a terminal end of the volute, the protrusion faces a liquid outlet of the impeller, a radius of curvature of a cross section of a distal edge of the protrusion at one side end thereof is larger than a radius of curvature of the cross section of the distal edge of the protrusion at other side end thereof, and the other side end faces the main plate while the one side end is located opposite to the main plate, and wherein the one side end of the distal edge of the protrusion is thicker than the other side end of the distal edge of the protrusion.

2. The volute pump according to claim 1, wherein the radius of curvature of the cross section of the distal edge of the protrusion increases from a second value to a first value at a constant rate, where the first value is the radius of curvature at the one side end and the second value is the radius of curvature at the other side end.

3. The volute pump according to claim 1, wherein the radius of curvature of the cross section of the distal edge of the protrusion increases stepwise from a second value to a first value, where the first value is the radius of curvature at the one side end and the second value is the radius of curvature at the other side end.

4. The volute pump according to claim 1, wherein the radius of curvature of the cross section of the distal edge of the protrusion increases from a second value to a first value at a continuously varying rate of increase, where the first value is the radius of curvature at the one side end and the second value is the radius of curvature at the other side end.

5. A volute pump comprising:

an impeller having a main plate and a rotary vane fixed to the main plate; and a pump casing having a flow passage in a shape of volute for delivering a liquid, discharged from the impeller, in a circumferential direction, wherein the pump casing includes a protrusion projecting into the flow passage and separating a starting end of the volute from a terminal end of the volute, the protrusion faces a liquid outlet of the impeller, a gap between the impeller and a distal edge of one side end of the protrusion is larger than a gap between the impeller and a distal edge of the other side end of the protrusion, and the other side end faces the main plate while the one side end is located opposite to the main plate and wherein the one side end of the distal edge of the protrusion is thicker than the other side end of the distal edge of the protrusion.

6. The volute pump according to claim 5, wherein a gap between the protrusion and the impeller increases from a second value to a first value at a constant rate, where the first value is the gap between the one side end and the impeller and the second value is the gap between the other side end and the impeller.

7. The volute pump according to claim 5, wherein a gap between the protrusion and the impeller increases stepwise from a second value to a first value, where the first value is the gap between the one side end and the impeller and the second value is the gap between the other side end and the impeller.

8. The volute pump according to claim 5, wherein a gap between the protrusion and the impeller increases from a second value to a first value at a continuously varying rate of increase, where the first value is the gap between the one side end and the impeller and the second value is the gap between the other side end and the impeller.

* * * * *